United States Patent [19]

Kroeger et al.

[11] Patent Number: 4,583,429

[45] **Date of Patent: * Apr. 22, 1986**

[54] TAB TOP CAN OPENER

[76] Inventors: Daniel E. Kroeger, 511 Sycamore, Hayward, Calif. 94544; Robert C. Anderson, 6215 Manthey Rd., French Camp, Calif. 95231

[ * ] Notice: The portion of the term of this patent subsequent to Dec. 28, 1999 has been disclaimed.

[21] Appl. No.: 193,246

[22] Filed: Oct. 2, 1980

[51] Int. Cl.[4] ..... B67B 7/40

[52] U.S. Cl. ..... 81/3.55; 7/151

[58] Field of Search ..... 81/3.1 R, 3.1 C, 3.34, 81/3.46 R, 3.46 A, 3.47, 3.48; 7/151; 220/212; 294/26, 27 H, 12, 14

[56] References Cited

U.S. PATENT DOCUMENTS

| | | | |
|---|---|---|---|
| D. 267,391 | 12/1982 | Kroeger et al. | D8/18 |
| 2,902,310 | 9/1959 | Berce | 81/3.1 R |
| 3,269,586 | 8/1966 | Quimby et al. | 220/212 |
| 3,656,375 | 4/1972 | Reed et al. | 81/3.46 R |
| 3,724,297 | 4/1973 | Bucko | 81/3.46 A |
| 4,034,595 | 7/1977 | Smith | 7/151 |
| 4,120,216 | 10/1978 | Goldberg | 81/3.46 R |
| 4,133,228 | 1/1979 | DePooter | 81/3.1 R |
| 4,207,781 | 6/1980 | Greenwood | 81/3.46 R |
| 4,241,626 | 12/1980 | Hall | 81/3.46 R |
| 4,253,352 | 3/1981 | O'Neal | 81/3.46 R |

*Primary Examiner*—Roscoe V. Parker

*Attorney, Agent, or Firm*—Townsend & Townsend

[57] ABSTRACT

A unitary opener device for tab-type cans, which is extremely inexpensive to fabricate, simple to use and reliable in operation. A first embodiment comprises a unitary member having a handle portion adapted to be gripped by a user, and a working end portion having a pair of relatively inflexible nose portions, the nose portions being separated by a slot dimensioned to receive the exposed portion of the can opening tab. One of the nose portions has a shorter length than the other, while each of the nose portions is provided with an external convex fulcrum surface adapted to engage the can surface bearing the tab to assist in raising the exposed portion of the tab away from the can surface and rupturing the seal between the tab and the can surface. A second embodiment comprises a unitary member having a handle portion adapted to be gripped by a user, and a working end portion having a single relatively inflexible nose portion dimensioned to be received in an aperture in the exposed portion of the can opening tab in frictional engagement therewith, so that insertion of the nose portion into the tab aperture, followed by rotation of the handle portion in a plane substantially perpendicular to the can surface, provides an opening force sufficient to rupture the seal between the tab and the can surface. The handle portion includes an inner surface with a portion adapted to contact the edge of the can, permitting the device to function as a handle.

2 Claims, 9 Drawing Figures

TAB TOP CAN OPENER

BACKGROUND OF THE INVENTION

This invention relates to devices for facilitating opening of tab top openers from cans, particularly beverage containing cans.

Since the advent of tab-type beverage cans, many devices have been designed to facilitate the step of opening the can, typically by lifting the tab to rupture the seal between the tab and the can top surface. Examples of such devices are found in the following U.S. Pat. Nos.

3,269,586
3,656,375
3,724,297
4,120,216
4,133,228

In spite of the numerous designs developed in the past, at present the need exists for a tab-type can opening device which is extremely inexpensive to fabricate, simple to use and reliable in operation.

SUMMARY OF THE INVENTION

The invention comprises a tab top can opening device which meets the criteria noted above.

In a first embodiment, the invention comprises an opener device comprising a unitary member having a handle portion adapted to be gripped by a user, and a working end portion having a pair of relatively inflexible nose portions the nose portions being separated by a slot dimensioned to receive the can opening tab. One of the nose portions has a shorter length than the other, while each of the nose portions is provided with an external convex fulcrum surface adapted to engage the can surface bearing the tab to assist in the operation of the device.

In use, the longer nose portion is initially inserted between the tab and the adjacent can surface, after which the handle portion is rotated downwardly in a plane substantially perpendicular to the tab until the tab is lifted away from the can surface to provide a clearance therebetween. Thereafter, the longer nose portion is withdrawn from the space between the tab and the can surface, the device is rotated 180° about its longitudinal axis, the device is advanced over the raised tab portion so that the latter is received in the slot between the nose portions, and the handle portion is rotated upwardly in a plane substantially perpendicular to the tab until the seal between the tab and the can surface is ruptured. Thereafter, the longer nose portion is withdrawn, the tab is manually bent down toward the can surface, and the contents of the can can then be dispensed.

In an alternate embodiment of the invention, the opener device comprises a unitary member having a handle portion adapted to be gripped by a user, and a working end portion having a single relatively inflexible nose portion dimensioned to be received in the aperture in the can opening tab in frictional engagement therewith, so that insertion of the nose portion into the tab aperture, followed by rotation of the handle portion in a plane substantially perpendicular to the tab, provides an opening force of sufficient magnitude to rupture the seal between the tab and the can surface. The handle portion of this embodiment includes an inner surface with a portion adapted to contact the edge of the can after the seal has been ruptured between the tab and the can surface, permitting the device to function as a handle for the can.

In use, the nose portion is inserted between the tab and the can surface and the handle portion is manipulated to pry the tab upwardly to expose the tab aperture. Next, the nose portion is inserted into the tab aperture until frictional engagement occurs therebetween, the handle portion is rotated in a plane substantially perpendicular to the tab until the seal between the tab and the can surface is ruptured, and the nose portion is withdrawn from the tab aperture. Thereafter, the tab is rotated by a predetermined angular amount (typically 90°) about an axis perpendicular to the can surface, and the nose portion is reinserted into the tab aperture until the inner surface portion of the handle contacts the edge of the can and the nose portion is maintained in frictional engagement with the tab aperture. The device now functions as a handle for the can, in a fashion similar to the handle on a glass mug.

Either embodiment of the invention is relatively simple to operate, and the nose portion(s) are fabricated in such a manner as to be relatively inflexible and not susceptible to fracture under pressure in order to provide long life for the device. In addition, in the embodiment of the invention having the single nose portion, the device provides the additional function of a handle as well as a tab top can opener.

For a fuller understanding of the nature and advantages of the invention, reference should be had to the ensuing detailed description taken in conjunction with the accompanying drawings.

DESCRIPTION OF THE PREFERRED EMBODIMENT

Figure 1A:
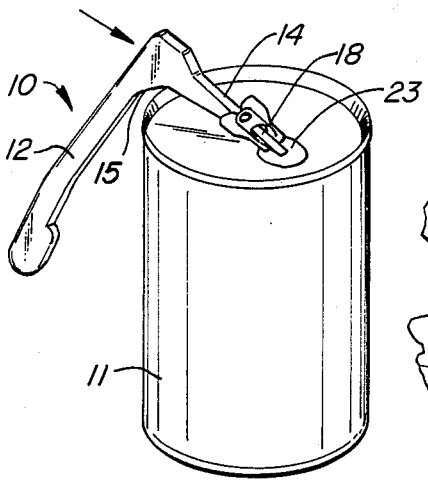
FIGS. 1A–1E are sequential views illustrating the structure and operation of the single nose portion embodiment of the invention.
Figure 1F:
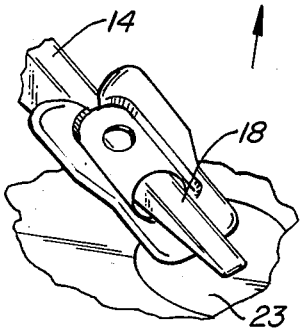
FIG. 1F is an enlarged detail view of the above embodiment.
Figure 1B:
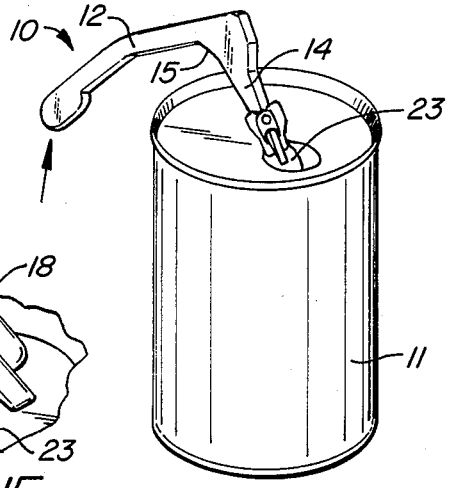
Figure 1C:
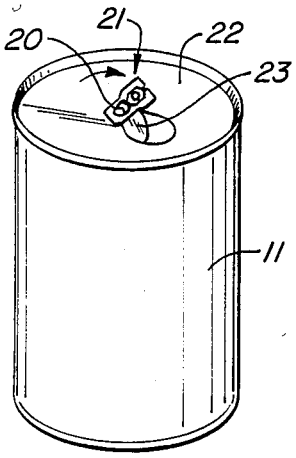
Figure 1D:
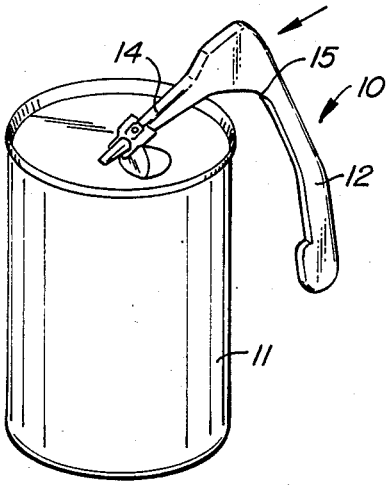
Figure 1E:
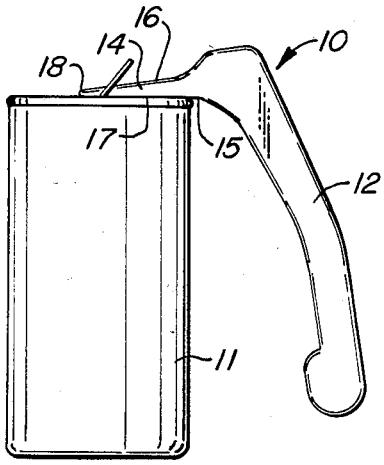

Turning now to the drawings, FIGS. 1A–1F illustrate the structure and operation of the single nose portion embodiment of the invention. As seen in these figures, the opener device comprises a unitary structure generally designated with reference 10 having a handle portion 12 and a single nose portion 14. Handle portion 12 is provided with an inner surface having a portion 15 adapted to contact the edge of a can 11 when the device is cooperatively engaged with can 11 as shown in FIG. 1E.

Nose portion 14 is tapered along top and bottom surfaces 16, 17 to a beak end 18. The dimensions of single nose portion 14 are selected in such a manner that the beak end 18 may be readily inserted into the aperture 20 formed in tab 21 secured to the upper surface 22 of can 11, and the beak portion 14 may be progressively translated into the aperture 20 until frictional engagement occurs between the edges of the aperture 20 and the outer surface edges of nose portion 14 (see FIG. 1F). The exact point on nose portion 14 at which frictional engagement occurs will depend upon the relative dimensions of aperture 20 and nose portion 14; however, at some point along the length of nose portion 14 such engagement will occur.

In use, beak end 18 is inserted into aperture 20 until frictional engagement is encountered between nose portion 14 and aperture 20 of tab 21, after which the handle portion 12 is rotated in a plane generally perpendicular to the plane of the tab 21 (or the plane of the top surface 22). Upon such rotation, the seal formed between portion 23 of tab 21 and the top surface 22 of can 11 is ruptured, either by force of the tab alone or with the assistance of pressure between beak end 18 and portion 23 of tab 21 (FIG. 1B). After the seal has been ruptured, so that the contents of the can are dispensable, the opener device 10 is removed by withdrawing nose portion 14 from aperture 20, and the external portion of tab 21, which is typically riveted to the top surface 22, is rotated a predetermined angular amount (e.g., ninety degrees) about an axis perpendicular to surface 22. Thereafter, nose portion 14 is again inserted into aperture 20 (FIG. 1D) until inner surface portion 15 contacts the rim of can 11. Thereafter, the device may be used as a handle in a similar manner to the handle on a beer mug to dispense the contents of can 11. For cans 11 containing a liquid beverage, the ninety degree angular rotation of the tab 21 is preferred since the can and opener 10 function in combination in a manner similar to an ordinary mug.

Figure 2A:
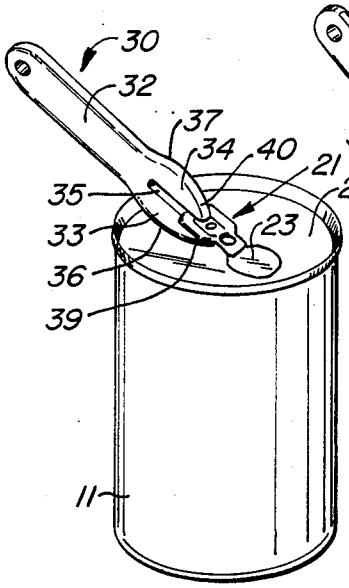
FIGS. 2A–2C are sequential views illustrating the structure and use of the dual nose portion embodiment of the invention.
Figure 2B:
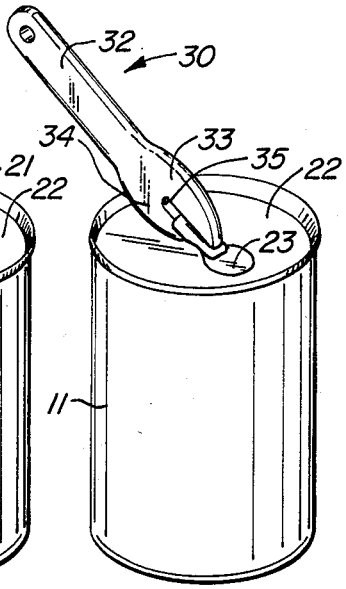
Figure 2C:
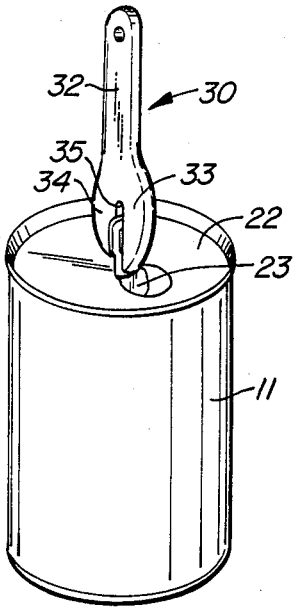

FIGS. 2A–2C illustrate an alternate embodiment of the invention which is more suitable for use in multiple can opening applications, such as those encountered by an employee of a soft drink counter or a cocktail lounge. As seen in these figures, the invention comprises a unitary member generally designated with reference 30 having a handle portion 32 and a working end portion including a first nose portion 33 and a second nose portion 34. Both nose portions are separated by an elongate slot 35 having a dimension sufficient to receive the exposed portion of tab 21 above the surface 22 of can 11. Each nose portion 33, 34 is also provided with a convex fulcrum surface 36, 37 to aid in the use of the opener 30 in the manner described below. Each nose portion 33, 34 is also provided with a beak end 39, 40.

In use, the beak end 39 of nose portion 33 is initially inserted under tab 21, and handle portion 32 is rotated downwardly in a plane perpendicular to tab 21 (or top can surface 22) until the exposed tab portion has been raised to provide some clearance between the exposed portion of tab 21 and can surface 22 (FIG. 2A). Next, nose portion 33 is withdrawn from tab 21, the device is rotated about its longitudinal axis by one hundred eighty degrees, and advanced onto tab 21, with the exposed portion of tab 21 being received in the slot 35. Thereafter, handle portion 32 of opener 30 is rotated upwardly in a plane perpendicular to the plane of tab 21 (or can surface 22), thereby forcing tab 21 to follow the same general path of motion until the seal between portion 23 of tab 21 and surface 22 is ruptured sufficiently to enable the contents of can 11 to be dispensed. Thereafter, the opener 30 is removed from the can, and the tab 21 is then pressed down toward the can surface 22.

During the seal opening procedure, as well as the tab lifting procedure, fulcrum surfaces 36, 37 bear on the surface 22 of can 11 to facilitate lifting of the tab 21, surface 22 functioning as a reference guide surface to aid the user.

The invention may be fabricated from several different materials, including metal such as aluminum, steel or the like, and any one of a number of suitable plastic materials. In selecting a suitable material, care must be taken to ensure that nose portion 14 of the FIG. 1 embodiment and nose portions 33, 34 of the FIG. 2 embodiment will be durable over repeated uses and will neither fracture, nor suffer surface wear to the point where frictional engagement with the edges of aperture 20 can no longer be obtained (in the FIG. 1 embodiment). As will be further evident, the device may be inexpensively fabricated and is virtually foolproof in use.

While the above provides a full and complete disclosure of the invention, various modifications, alternate constructions and equivalents may be employed without departing from the true spirit and scope of the invention. For example, if desired, the embodiment of FIG. 2 may be provided with an additional handle portion, such as an ice pick handle, to further facilitate the use of the device over prolonged periods of time. Therefore, the above description and illustrations should not be construed as limiting the scope of the invention, which is defined by the appended claims.

What is claimed is:

1. An opener device for use with a can opening tab releasably sealed to a can surface, said device comprising a unitary member having a handle portion adapted to be gripped by a user, and a working end portion, said working end portion having first and second relatively inflexible nose portions extending in a generally mutually parallel direction, said second nose portion terminating in a free end and having a length less than the length of said first nose portion, said first nose portion having a curved convex outer working surface terminating in a free end with a thickness dimension sufficiently small to permit insertion thereof between said tab and said can surface so that subsequent rotation of said handle portion in a plane substantially perpendicular to said can surface causes said convex outer working surface to bear against said can surface and provide a lifting force of sufficient magnitude to raise said tab away from said can surface, said nose portions being separated by a slot dimensioned to receive said tab to permit said tab to be engaged with said slot with the first nose portion extending along the top of said tab and the second nose portion extending along the bottom of said tab so that advancement of said first and second nose portions over said tab and rotation of said handle portion in said plane provides an opening force of sufficient magnitude to rupture the seal between said tab and said can surface.

2. A method of opening a can having an apertured can opening tab releasably sealed to a can surface, said method comprising the steps of:

(a) gripping the handle portion of an opener device having a longitudinal axis and a working end portion with first and second relatively inflexible nose portions separated by a slot dimensioned to receive an exposed portion of said tab, said second nose portion having a length less than the length of said first nose portion, said first nose portion having a taper terminating at the open end thereof;

(b) inserting said first nose between said exposed tab portion and said can surface;

(c) rotating said opener device in a plane generally perpendicular to said can surface to raise said exposed tab portion away from said can surface;

(d) rotating said opener device about the longitudinal axis thereof by substantially 180°;

(e) advancing said working end portion toward said exposed tab portion until said exposed tab portion is received in said slot; and (f) rotating said opener device in said generally perpendicular plane until the seal between said tab and said can surface is ruptured.

* * * * *